US005346403A

United States Patent [19]

Hyzin

[11] Patent Number: 5,346,403

[45] Date of Patent: Sep. 13, 1994

[54] CONNECTOR GROUNDING ARRANGEMENT

[75] Inventor: Peter J. Hyzin, Lake Forest, Calif.

[73] Assignee: ITT Corporation, Secaucus, N.J.

[21] Appl. No.: 95,243

[22] Filed: Jul. 22, 1993

[51] Int. Cl.[5] ..... H01R 13/648

[52] U.S. Cl. ..... 439/95

[58] Field of Search ..... 439/95-97, 439/108, 608

[56] References Cited

U.S. PATENT DOCUMENTS

| | | | |
|---|---|---|---|
| 3,569,915 | 3/1971 | Sorensen et al. | 439/608 |
| 4,029,386 | 6/1977 | Krantz, Jr. et al. | 439/608 |
| 4,362,350 | 12/1982 | von Harz | 439/608 |
| 4,428,639 | 1/1984 | Hillis | 439/609 |
| 4,440,463 | 4/1984 | Gliha, Jr. et al. | 439/97 |
| 4,666,222 | 5/1987 | Gallusser et al. | 439/108 |
| 5,151,033 | 9/1992 | Kawai et al. | 439/95 |
| 5,151,035 | 9/1992 | Kawai et al. | 439/95 |
| 5,169,323 | 12/1992 | Kawai et al. | 439/95 |
| 5,240,424 | 8/1993 | Honma et al. | 439/95 |

*Primary Examiner*—Gary F. Paumen
*Attorney, Agent, or Firm*—Thomas L. Peterson

[57] ABSTRACT

A grounding clip (60, FIG. 3) is described for mounting in a connector insert (20) to connect the outside of a coaxial contact (26) to a metal shell that surrounds the insert. The clip is formed of a strip of sheet metal with a middle (82) bent into a circle to form a band that closely surrounds and contacts the coaxial contact, the strip having opposite end portions (90, 92) that are each bent in a reverse curve and extend to the outside of the insert to engage the shell. The forward edge (162, FIG. 5) of the band has axiallyextending slits (164), with a sheet metal portion (166) at one side of each slit being bent about an inclined bend line (168) to project radially inwardly towards the axis (84) of the band to provide a small area of high pressure contact with the coaxial contact. The band has slots (180) that form retainer tines (182) which extend forwardly and radially inwardly, to abut a shoulder on a flange (80, FIG. 3) of the coaxial contact. The clip end portions (90, 92, FIG. 3) which lie outside the insert, each includes an arm (116, 118) that extends rearwardly and that has a rearward end (120, 122) that is bent to lie on a rearwardly-facing shoulder (126) of the insert. The connector includes a holdown plate (36, 38, FIG. 2) which is fastened to the shell (16), and when so fastened presses firmly against the arm ends (120, 122) to provide an area of high pressure contact between the clip and the shell.

9 Claims, 4 Drawing Sheets

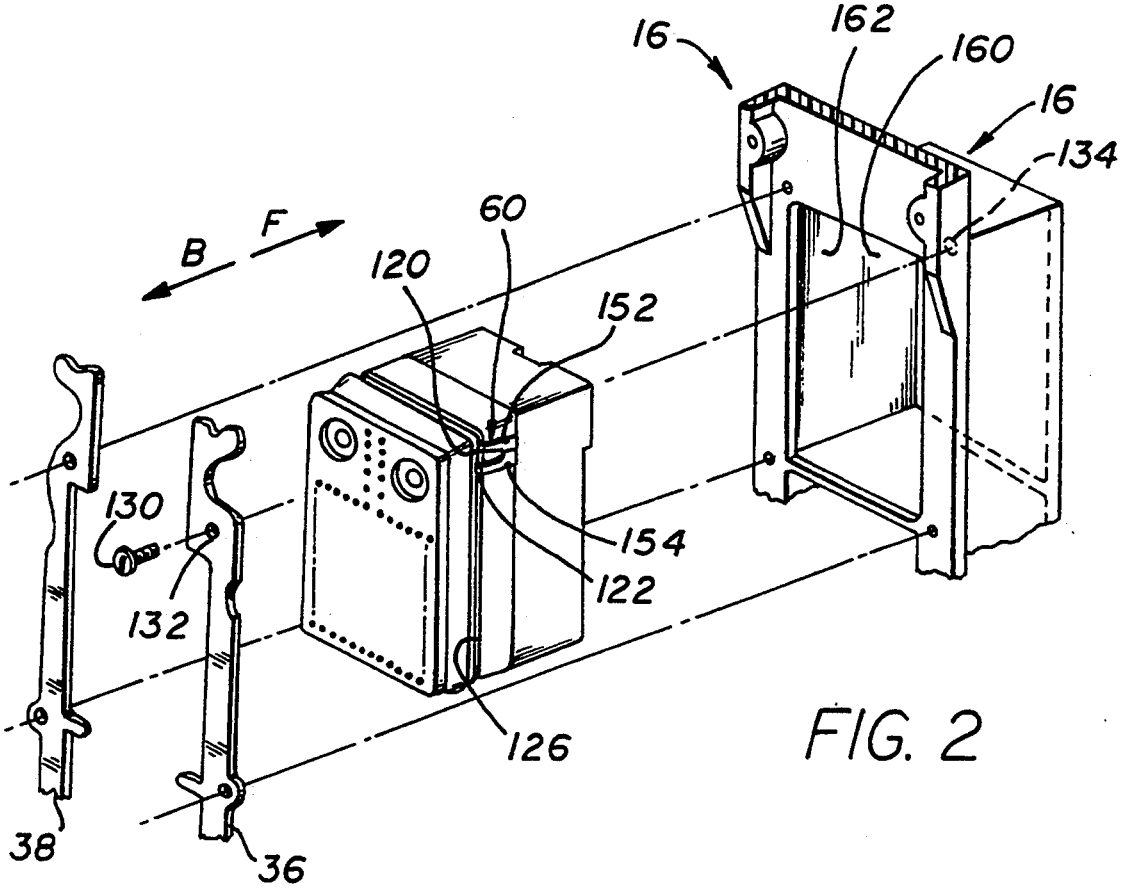
FIG. 2
FIG. 4
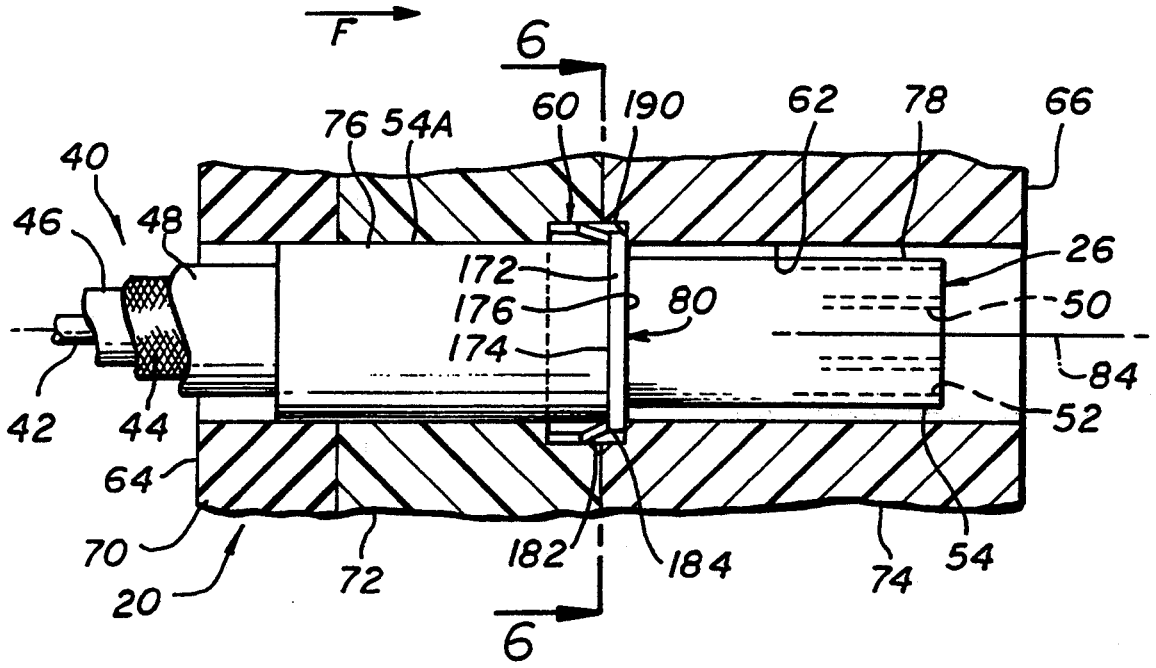

FIG. 5
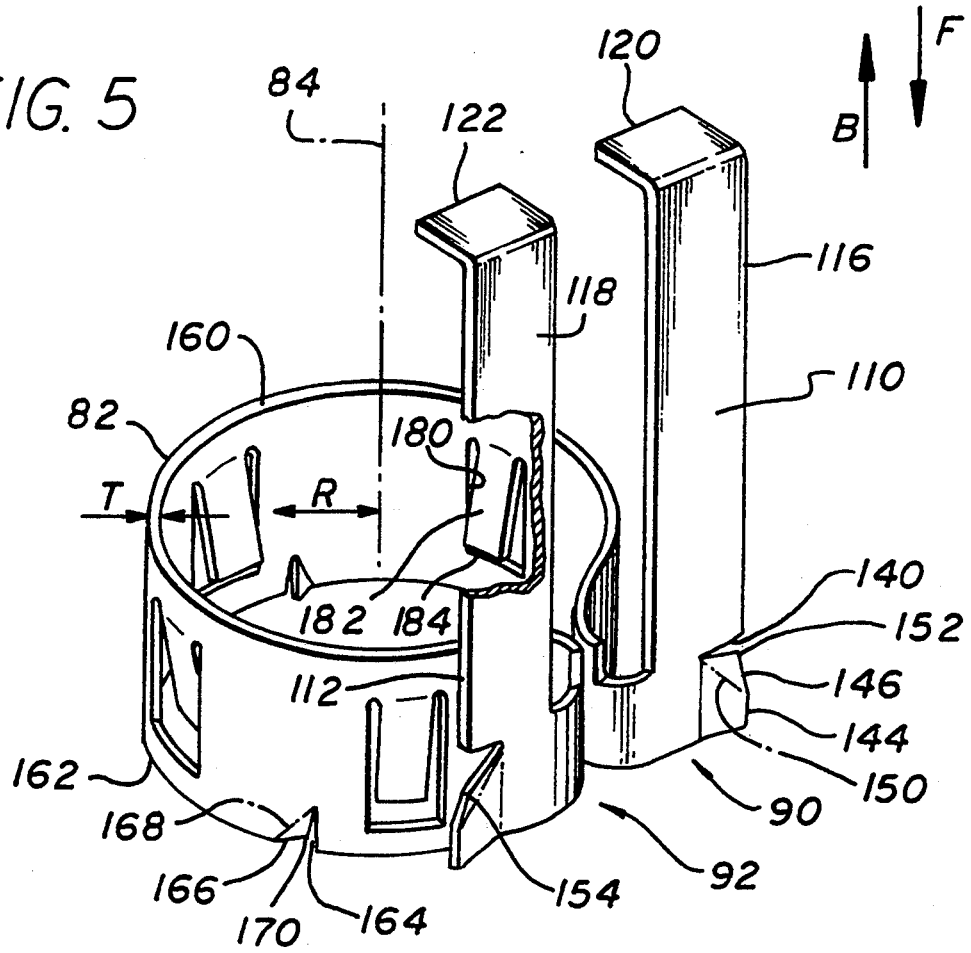
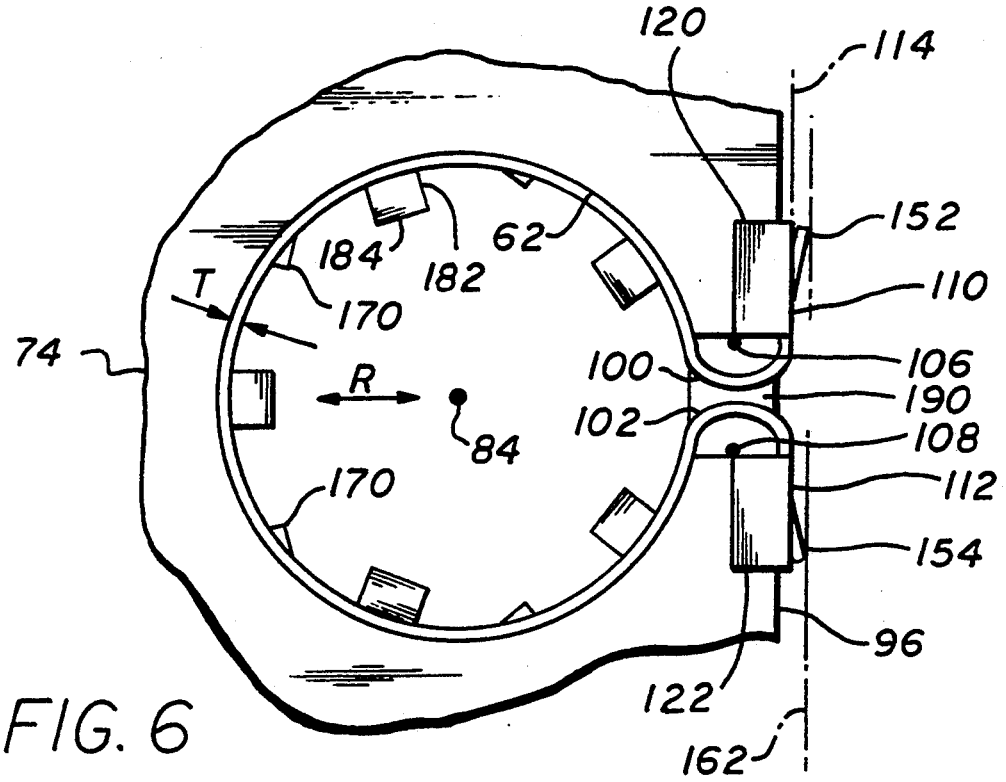
FIG. 6

CONNECTOR GROUNDING ARRANGEMENT

BACKGROUND OF THE INVENTION

Connectors often require an electrically conductive clip to connect a contact lying in a dielectric insert of the connector, to the conductive metal shell that surrounds the insert. For example, a contact or contact assembly attached to an end of a coaxial cable, may be installed in the insert of a connector, with the central conductor of the coaxial contact forming a pin or socket contact and with the outer conductor connected to the metal shell of the connector to shield the central conductor. A low cost clip which provided reliable, low resistance connection between the outer conductor of a coaxial contact and a conductive shell of a connector, would be of value.

SUMMARY OF THE INVENTION

In accordance with one embodiment of the present invention, a grounding clip is provided for connecting an outside conductor of a coaxial contact assembly that lies in a dielectric insert, to a conductive shell that lies around the insert. The clip is formed of a strip of sheet metal, with a band part that is bent in a circle about an axis, with the thickness dimension of the sheet metal extending radial to the axis. The band has forward and rearward edges, and has slits in a first edge. A sheet metal portion at one side of each slit is bent radially inwardly to engage the contact assembly. The bend line preferably extends at an angle to the clip axis, so the corner, where a slit side meets the first edge of a band, engages the contact assembly to provide a high pressure engagement for low resistance contacting. The band also has slots forming retaining tines that engage a shoulder at a flange of the contact assembly, to position the flange so its periphery is engaged by the bent sheet metal portions at the sides of the slits. The opposite end portions of the strip, whose middle forms the band, are each bent in a reverse curve to leave outer parts that extend away from each other and primarily parallel to each other. Each outer part forms a rearwardly-extending arm that extends along the outside of the insert, with the end of each arm being bent to lie against a rearwardly-facing shoulder of the insert. A holdown plate is mounted on the shell and presses firmly against the arm ends to provide a low resistance path between the clip and the shell. The outer parts also include slits leaving portions bent at an incline to further engage the shell.

The novel features of the invention are set forth with particularity in the appended claims. The invention will be best understood from the following description when read in conjunction with the accompanying drawings.

BRIEF DESCRIPTION OF THE DRAWINGS

FIG. 2 is an exploded isometric view of a portion of one of the connectors of the connector assembly of FIG. 1.

FIG. 4 is a sectional view of the connector assembly, clip, and insert of FIG. 4.

FIG. 5 is an isometric view of the clip of FIG. 3.

FIG. 6 is a sectional view taken on the line 6—6 of FIG. 4.

DESCRIPTION OF THE PREFERRED EMBODIMENT

Figure 1:
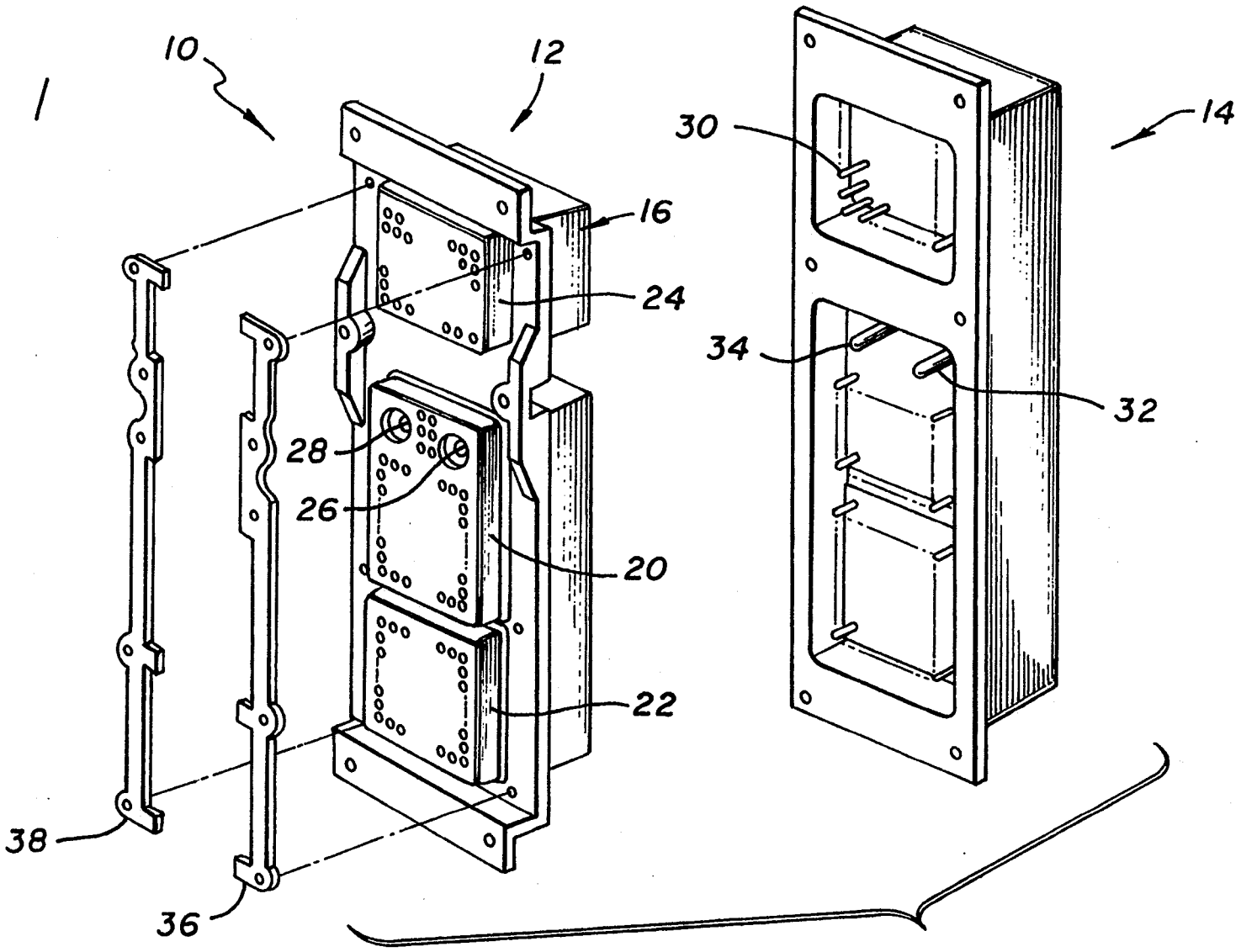
FIG. 1 is an exploded isometric view of a connector assembly constructed in accordance with the present invention.

FIG. 1 illustrates a connector assembly 10 which includes a first connector 12 that can mate with a second connector 14. The first connector includes a shell 16 and inserts 20, 22, 24 that are mounted in cavities of the shell. One of the inserts 20 includes a pair of coaxial contacts 26, 28. Each of the inserts includes numerous pin or socket contacts. The connector 14 includes numerous pin or socket contacts 30, including a pair of contacts 32, 34 which mate with the coaxial contacts 26, 28. The connector 12 includes a pair of holdown plates 36, 38 which fasten to the shell 16, as will be described below.

As shown in FIG. 4, the coaxial contact 26 is connected to a coaxial cable 40 which includes inner and outer conductors 42, 44. The cable includes an inner insulation 46 separating the conductors and an outer insulation or jacket 48 protecting the outer conductor. The inner conductor 42 is used to carry signals with significant high frequency components, which may be analog or digital signals, and the outer conductor 44 is electrically grounded to safeguard the inner conductor 42 from EMI (electromagnetic interference). The coaxial contact 26 includes an inner contact part 50 that connects to the cable inner conductor 42, and includes an outer contact part 52 that has a grounded outer surface 54. The outer surface 54 is electrically grounded by a metal clip 60 which contacts the outer surface 54 of the coaxial contact and which also contacts the metal shell 16 (FIG. 1) of the connector. The coaxial contact 26 (FIG. 4) lies in a passage 62 that is formed in the dielectric insert 20, with the passage extending completely through the insert between its forward and rearward ends 66, 64.

The dielectric insert 20 has three sections 70, 72, and 74. The coaxial contact 26 has rearward and forward portions 76, 78 with a flange 80 between them. The clip 60 engages the flange 80 to fix the position of the coaxial contact and make good electrical contact therewith. It is noted that the insert sections 72, 74 must be separated to receive the clip.

Figure 3:
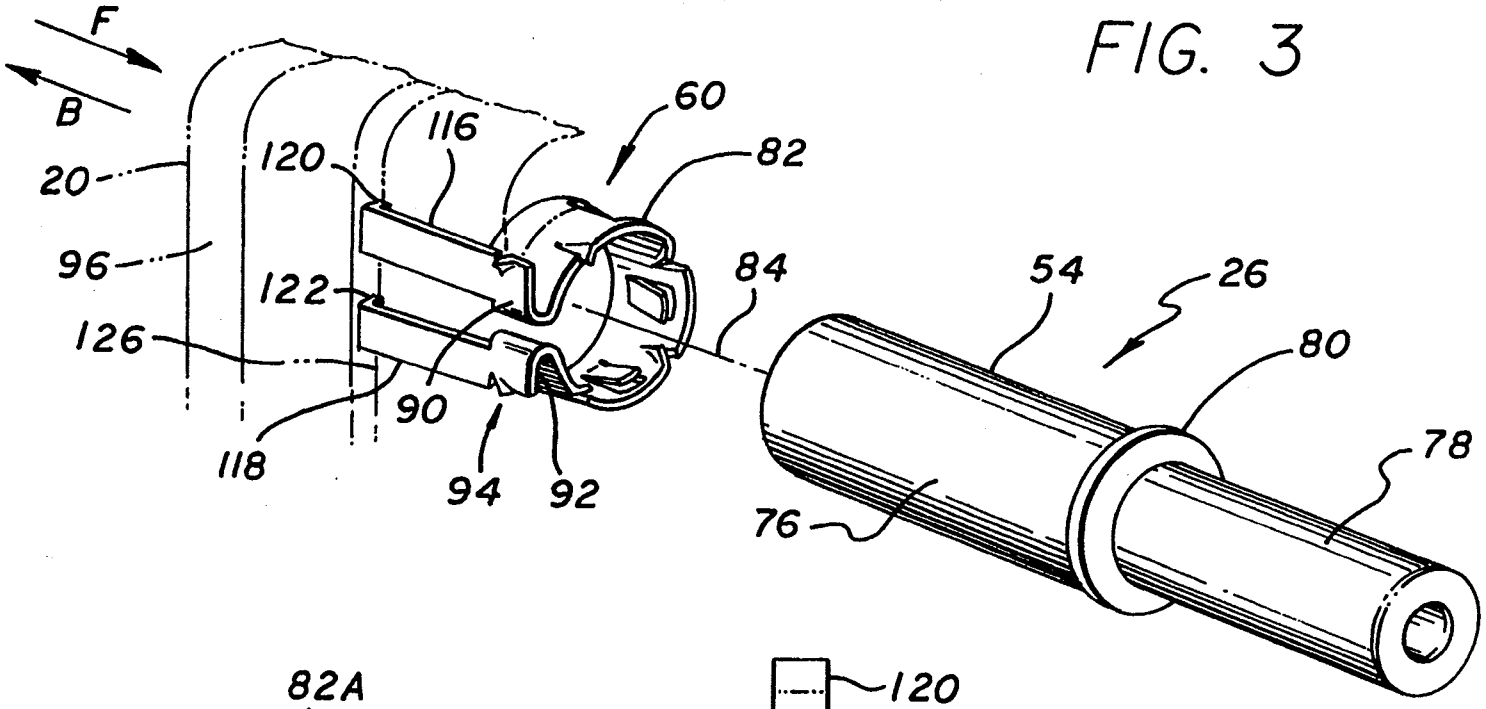
FIG. 3 is an exploded isometric view of a grounded contact assembly and clip of the connector of FIG. 2, with the connector insert being indicated by phantom lines.

As shown in FIG. 3, the clip 60 has a middle or band portion 82 that is bent substantially in a circle about an axis 84 of the clip and of the passage that receives it. The clip also includes opposite end portions 90, 92 that extend to the outside of the insert 20 and which form an outside part 94 of the clip. The outside part 94 of the clip is trapped between a side 96 of the insert which lies on its outside, and a wall of the connector shell, to assure that the shell wall presses firmly against the shell and thereby connects the shell to the grounded outer surface 54 of the coaxial contact.

Figure 7:
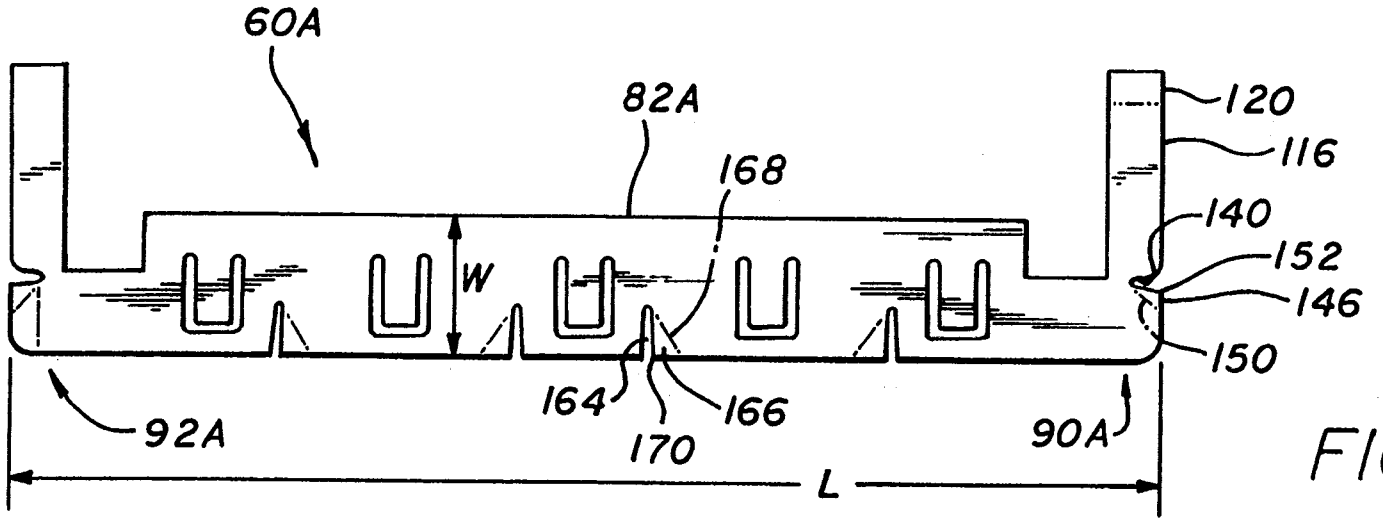
FIG. 7 is a plan view of a sheet metal strip which has been blanked, but not yet bent, and which forms the clip of FIG. 5.

FIG. 7 shows a clip precursor 60A, which is a strip or length of sheet metal that has been blanked from a larger sheet, but which has not yet been bent to the shape of the final clip. The strip has a substantially uniform thickness T (FIG. 5), a median strip width W which is a plurality of times greater than T, and a length L which is greater than W. The strip has a middle 82A and has opposite end portions 90A, 92A. As shown in FIG. 5, the strip is bent about a clip axis 84 (which is coincident with the passage axis when the clip is installed therein). The sheet metal strip is bent so the thickness dimension T extends in a radially direction R with respect to the axis, and the width dimension W extends axially. Each of the end portions 90, 92 of the strip has an inner part 100, 102 (FIG. 6) that is bent in a reverse curve about an axis 106, 108 that extends parallel to the clip axis 84. The thickness dimension T of the sheet metal is seen in a view along the axis 84, even along the reversely bent outer parts 100, 102. The end portions have outer parts 110, 112 which extend away from each other and preferably lie in substantially a common plane 114. The outer parts 110, 112 of the clip each forms a rearwardly-extending arm 116, 118 (FIG. 5), which extends axially (parallel to axis 84) in a forward direction from the position of the band portion 82. Each arm has a far or rearward end 120, 122 which is bent about 90° from the rest of the arm to extend generally towards the band axis 84. When the clip is installed, as shown in FIG. 3, the arm ends 120, 122 lie against a generally axially-facing shoulder 126 which faces primarily in rearward direction B and which lies at a side of the insert 20. When the holdown plate 36 (FIG. 2) is installed on the shell 16, as with screws 130 that pass through holes 132 in the plate and were threaded into corresponding holes 134 in the shell, the plate presses axially against the arm ends 120, 122. Such firm pressing results in good electrical contact between the holdown plate 36 and the arm ends 120, 122, with the holdown plate being electrically connected to the shell by pressing thereagainst through the use of the screws.

Referring again to FIG. 5, it can be seen that the outer parts 110, 112 of the clip outside part, have slits 140. Each slit extends primarily perpendicular to the band axis 84 and leaves a sheet metal section having an outer edge 146. The section 144 is bent along a bend line 150 that is angled between 10° and 80° from the slit 140, with the section bending being in a direction away from the band axis 84. This results in a protruding location 152 on the band outer portion, which can engage the shell. As shown in FIG. 2, the shell has a cavity 160 with cavity walls 162 that closely receive the insert. The insert can be installed by pressing it forwardly in the direction F into the cavity. As the insert is pressed forwardly into the cavity, the projecting locations 152, 154 on the clip outer portions, scrape along the shell cavity walls 162 to make wiping contact therewith. As shown in FIG. 6, the projecting locations 152, 154 have a small area, so they provide large pressure over a small area, to provide a low resistance connection to the shell. Thus, the clip makes low resistance contact with the shell at the two projecting locations 152, 154, as well as at the two arm ends 120, 122.

Referring again to FIG. 5, it can be seen that the circular band has forward and rearward edges 162, 160. The forward edge 162 has a plurality of slits 164, with a sheet metal portion 166 lying at one side of each slit. The sheet metal portion 166 is bent about a bend line 168 to place a location 170 along a side of the slit closer to the band axis 84 than other regions of the band adjacent to the slit 164. The contact locations 170 are positioned to contact the grounded outer surface 54 (FIG. 4) of the coaxial contact, and more particularly the outer or peripheral surface 172 of the flange 80. The flange forms rearward and forward shoulders 174, 176, which are used to locate the flange to assure that the clip locations 170 will contact the flange peripheral surface 172.

As shown in FIG. 5, applicant forms the band part with a plurality of slots 180 that leave a plurality of retainer tines 182. Each retainer tine extends forwardly towards the front edge 162 of the band, and has a front free end 184. As shown in FIG. 4, the flange 80 is prevented from forward movement by its forward shoulder 176 abutting a shoulder 190 on the insert section 74. The rearward shoulder 174 of the flange is abutted by the free ends 184 of the retention tines 182 of the clip. The free ends 184 are located so that when they abut the flange, the peripheral surface 172 of the flange is contacted by the sheet metal portions 166 (FIG. 5) at the clip slits 164, and especially by the contact locations 170. The tines 182 are bent so they extend forwardly and with an axially-inwardly directional component (towards the band axis 84). It may be noted that the bend axis 168 extends at an angle from the clip axis 84, so the location 170 lies at the corner where the slit 164 meets the forward edge 162 of the clip.

A clip that applicant has constructed and successfully tested was constructed of beryllium copper sheet metal having a thickness T of 0.006 inch (0.15 mm). The band had a width W of 0.160 inch (4.1 mm) and a length L of 1.34 inch (34 mm). The circular band had an outside diameter, when installed in the insert, of about 0.33 inch (8.5 mm). The other dimensions are shown relative to those above, in FIG. 7. The frontmost insert 74 (FIG. 6) is provided with a slot 190 extending between the passage 62 and the side 96 of the insert, through which pass the outer parts 100, 102 of the clip end portions. The above arrangement results in the electrical connection of the clip to the shell, having a resistance of about 2.5 miliohm.

Although the grounding clip is shown used to connect the outer conductor of a coaxial cable to a connector shell, the same clip is also useful to connect a simple grounded contact to the shell or the outer conductor of a triaxial cable etc.

Thus, the invention provides a grounding clip, and provides a connector which includes the grounding clip to connect a contact lying in a connector insert to the shell of the connector. The clip is formed of sheet metal and has a middle bent into a circle and outer portions that extend to the outside of the insert and against the shell. The outer portions include inner parts that extend in a reverse bend about axes parallel to the band axis, from the circular middle band portion of the clip. The outer portions include outer parts that each includes an arm with an arm end that lies on a largely rearwardly-facing shoulder of the insert. A holdown plate which is mechanically and electrically connected to the shell, presses forwardly against the arm ends to provide good contact therewith. The clip outer portions also can include a slit with a portion at the side of the slit bent to provide a location that engages the walls of the shell cavity when the insert is inserted therein. The middle band portion of the clip is formed with slits at one edge, with a portion at one side of the slit bent to extend partially radially inwardly to provide a location that engages the grounded outer surface of the contact. The middle circular band also includes slots that form retainer tines with free ends located to abut a flange on the contact to locate the flange so the locations at the side of each slit in the band engage the peripheral surface of the flange. One insert section is formed with a sideward passage to pass outer portions of the bands from the contact-holding passage to an outside side of the insert.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A connector which includes a conductive shell having a cavity, a dielectric insert lying in said shell cavity and having sides at the outside of the insert and having forward and rearward ends and having a passage extending between its ends with the passage having a passage axis, a grounded contact which lies in said insert passage and which has a grounded outer surface and which has a rear end for connection to a cable having a grounded part, and a clip which is formed of sheet metal and which has a band part that lies around and in engagement with said contact and which has an outside part which extends to the outside of said insert and engages said shell, characterized by:

said band part is bent in substantially a circle about said axis with the thickness dimension of said sheet metal extending radial to said axis, and said band has forward and rearward edges, and said band has a plurality of slits at a first of said edges, with a sheet metal portion at one side of each slit being bent to form a location that is positioned substantially along a side of the slit so said location lies closer to said axis than adjacent parts of said band and so said location contacts said grounded contact.

2. The connector described in claim 1 wherein:

said slits extend primarily parallel to said axis and said sheet metal portion at one side of each slit is bent about a bend line that lies substantially on said sheet metal but that extends at an incline of more than 10° to said passage axis, so the corner where said first band edge and said slit meet, lies closest to said axis.

3. The connector described in claim 1 wherein:

said grounded contact has forward and rearward portions and a radially outwardly-extending flange between them, said flange having forward and rearward shoulders;

said band part includes a plurality of slots that leave a plurality of retainer tines that extend with a radially inward directional component and toward but not all the way to said first band edge, said tines having free ends, said tine free ends being axially spaced from said slit side locations, and said tine free ends substantially abut one of said shoulders while said slit side locations press against said flange.

4. The connector described in claim 1 including:

a holdown plate which is fastened to one of said ends of said shell at a location adjacent to a first of said sides of said insert;

said insert having a generally axially facing shoulder at said first side thereof, said outside part of said clip having an arm which has an arm end that lies against said shoulder, and said holdown plate presses axially against said arm end.

5. The connector described in claim 1 wherein:

said clip includes a length of sheet metal that has a middle forming said band part and that has opposite end portions which are each bent in a reverse curve about an axis extending parallel to said passage axis but which lies outside said circle, with each end portion contacting said shell.

6. The connector described in claim 5 wherein:

said insert has a plurality of insert sections that each forms part of said passage, with one of said insert sections having a slot extending from said passage to the outside of the insert and with said opposite end portions of said length of sheet metal extending through said slot.

7. A connector which includes a conductive shell having a cavity, a dielectric insert lying in said shell cavity and having sides at the outside of said insert, said insert having forward and rearward ends and having a passage extending between its ends with said passage having a passage axis, a grounded contact which lies in said insert passage and which has a grounded outer surface and which has a rear end for connection to a cable having a grounded part, and a sheet metal clip which has a band portion that has opposite ends and that is bent substantially in a circle about said passage axis with the thickness dimension of said sheet metal extending radial to said axis, with said band portion lying around and engaging said contact and with said clip having an outside portion which extends outside said passage to the outside of said insert and engages the walls of said shell cavity, characterized by:

a holdown plate which is fastened to one of said ends of said shell at a location adjacent to a first of said sides of said insert;

said insert having a generally axially facing shoulder at said first side thereof, said outside portion of said clip having an arm which has an arm end that lies against said shoulder, and said holdown plate presses axially against said arm end;

said clip outside portion including inner parts that each extends from one of said band portion ends, with said inner parts each bent about an axis extending parallel to said passage axis to lie beyond said circle and extend largely away from each other, and said clip outside portion including outer .parts extending from said inner parts and lying largely in a common plane and forming arm devices, with a first of said arm devices forming said arm.

8. The connector described in claim 7 wherein:

each of said outer parts of said clip outer portions includes a slit that forms a sheet metal section at one side of the slit, with said sheet metal section having an outer edge lying furthest from said band, said sheet metal section being bent along a bend line to place an outer edge location lying substantially along said outer edge further from said passage axis than other portions of said section, and with said outer edge location engaging said walls of said shell cavity.

9. The connector described in claim 8 wherein:

said bend line extends at an incline of more than 10% but less than 80° to said passage axis, so said outer edge location lies substantially at the intersection of one side of said slit and said outer edge.

* * * * *